US005238050A

United States Patent [19]

Folder et al.

[11] Patent Number: 5,238,050

[45] Date of Patent: Aug. 24, 1993

[54] STRIP CASTING

[75] Inventors: William J. Folder, North Wollongong; John Freeman, Kahibah, both of Australia

[73] Assignees: Ishikawajima-Harima Heavy Industries Company Limited, Tokyo, Japan; John Lysaght Limited, New South Wales, Australia

[21] Appl. No.: 879,395

[22] Filed: May 7, 1992

[30] Foreign Application Priority Data

May 23, 1991 [AU] Australia ..... PK6298
Nov. 21, 1991 [AU] Australia ..... PK9597

[51] Int. Cl.[5] ..... B22D 11/06; B22D 11/10; B22D 41/50

[52] U.S. Cl. ..... 164/480; 164/428; 164/437; 164/489; 222/590; 222/591

[58] Field of Search ..... 164/480, 489, 428, 437; 222/591, 590

[56] References Cited

U.S. PATENT DOCUMENTS 4,790,368 12/1988 Kusakawa et al. ..... 164/480
4,865,115 9/1989 Hirata et al. ..... 164/437

FOREIGN PATENT DOCUMENTS 62-270254 11/1987 Japan ..... 164/428
0130297 7/1919 United Kingdom ..... 222/591

OTHER PUBLICATIONS

Abstract of Japanese Patent Appln. No. 59-127305 (Publication No. 61-7050), published Jan. 13, 1986.

*Primary Examiner*—Kurt C. Rowan
*Assistant Examiner*—Jeffrey T. Knapp
*Attorney, Agent, or Firm*—Nikaido, Marmelstein, Murry & Oram

[57] ABSTRACT

With reference to FIG. 4, a metal delivery nozzle (19) for delivering molten metal to a nip between a pair of strip casting rollers comprises an upwardly opening inlet trough (61) to receive a series of free falling vertical stream (65) of molten metal and a metal flow passage (62) extending downwardly from the bottom of the inlet trough (61) to a metal flow outlet slot (69). Trough (61) has a side wall surface (64) which slopes downwardly and across the trough to the upper end of the metal flow passage (62). The free falling streams (65) impinge on side wall surface (64) at an acute angle of impingement such that the molten metal tends to adhere to that wall surface and to spread into the form of a sheet (70) flowing down the side wall surface.

18 Claims, 5 Drawing Sheets

STRIP CASTING

TECHNICAL FIELD

This invention relates to the casting of metal strip. It has particular but not exclusive application to the casting of ferrous metal strip.

It is known to cast non-ferrous metal such as aluminium by continuous casting in a twin roll caster. Hot metal is introduced between a pair of contra-rotated horizontal casting rollers which are cooled so that metal shells solidify on the moving roller surfaces and are brought together at the nip between them to produce a solidified strip product at the outlet from the roller nip. The hot metal may be introduced into the nip between the rollers via a tundish and a metal delivery nozzle located beneath the tundish so as to receive a flow of metal from the tundish and to direct it into the nip between the rollers.

Although twin roll casting has been applied with some success to non-ferrous metals which solidify rapidly on cooling, there have been problems in applying the technique to the casting of ferrous metals. One particular problem has been the need to ensure a very even metal flow distribution across the width of the nip since even minor flow fluctuations can cause defects when casting ferrous metals. Previous proposals to achieve the necessary even flow have involved the provision of baffles and filters in the delivery nozzle outlet to reduce the kinetic energy of the falling molten metal in such a way as to produce a smooth even flow at the outlet. These proposals have met with some success but have generally required the flow to be constricted through a quite narrow outlet discharging into a pool of accumulated molten metal in the nip between the casting rollers. The present invention provides an alternative technique for obtaining an appropriately smooth even flow of molten metal. The technique enables easier control of the flow process and also enables the use of nozzles with wider slot outlets.

DISCLOSURE OF THE INVENTION

According to the invention there is provided a method o casting metal strip of the kind in which molten metal is introduced between a pair of parallel casting rollers via a metal delivery nozzle disposed above the nip between the rollers, wherein the delivery nozzle has an upwardly opening inlet trough to receive molten metal and a metal flow passage extending downwardly from the bottom of the inlet trough to a metal flow outlet from the nozzle and wherein molten metal is supplied to the delivery nozzle in one or more free falling streams so as to impinge on a side wall surface of the inlet trough of the nozzle at an acute angle of impingement such that metal from the or each stream adheres to the side wall surface to form a flowing sheet of metal on the side wall surface which is directed by the side wall surface into the outlet flow passage.

Preferably, said angle of impingement is in the range 10° to 50°.

Preferably, the molten metal is delivered to the nozzle in one or more substantially vertically falling streams and said side wall surface of the nozzle trough slopes downwardly and across the trough to intercept the or each stream at said acute angle of impingement and to deflect the flowing metal transversely of the vertical direction.

Said side wall surface may be provided with a pattern which promotes spreading of the molten metal transversely of the direction of the or each stream. The surface pattern may comprise a plurality of corrugations or undulations extending transversely to the direction of the or each falling stream.

Preferably, said wall surface curves downwardly and inwardly of the trough so as to direct said sheet flowing to the outlet passage with progressively increasing slope away from the vertical.

Preferably further, the outlet passage is shaped to direct metal flowing therethrough transversely of the nozzle against the direction of transverse deflection of the flow in the trough.

More particularly, the outlet passage may have an upper portion which extends transversely of the nozzle against the transverse deflection of the flow in the trough and a lower portion which extends substantially vertically to the nozzle outlet.

Preferably further, said lower part of the outlet passage has a discrete constriction spaced above the nozzle outlet.

The invention also provides a metal delivery nozzle for delivering molten metal to a nip between a pair of casting rollers, comprising an upwardly opening inlet trough to receive a free falling stream of molten metal and a metal flow passage extending downwardly from the bottom of the inlet trough to a metal flow outlet of the nozzle, wherein the trough has a side wall surface which slopes downwardly and across the trough to the metal flow passage whereby, in use of the nozzle, a free falling stream of molten metal can impinge on said side wall surface at an acute angle of impingement such that molten metal impinging on the side wall surface will adhere to that wall surface and flow in a sheet directed by the wall surface to the outlet passage.

Preferably, the side wall surface has a pattern which in use of the nozzle promotes spreading of the molten metal transversely to the direction of metal flow. More particularly, the side wall surface may be formed with a plurality of corrugations or undulations extending along the trough.

BRIEF DESCRIPTION OF THE DRAWINGS

In order that the invention may be more fully explained, one particular form of apparatus and its operation will be described in some detail with reference to the accompanying drawings in which.

BEST MODE OF CARRYING OUT THE INVENTION

Figure 1:
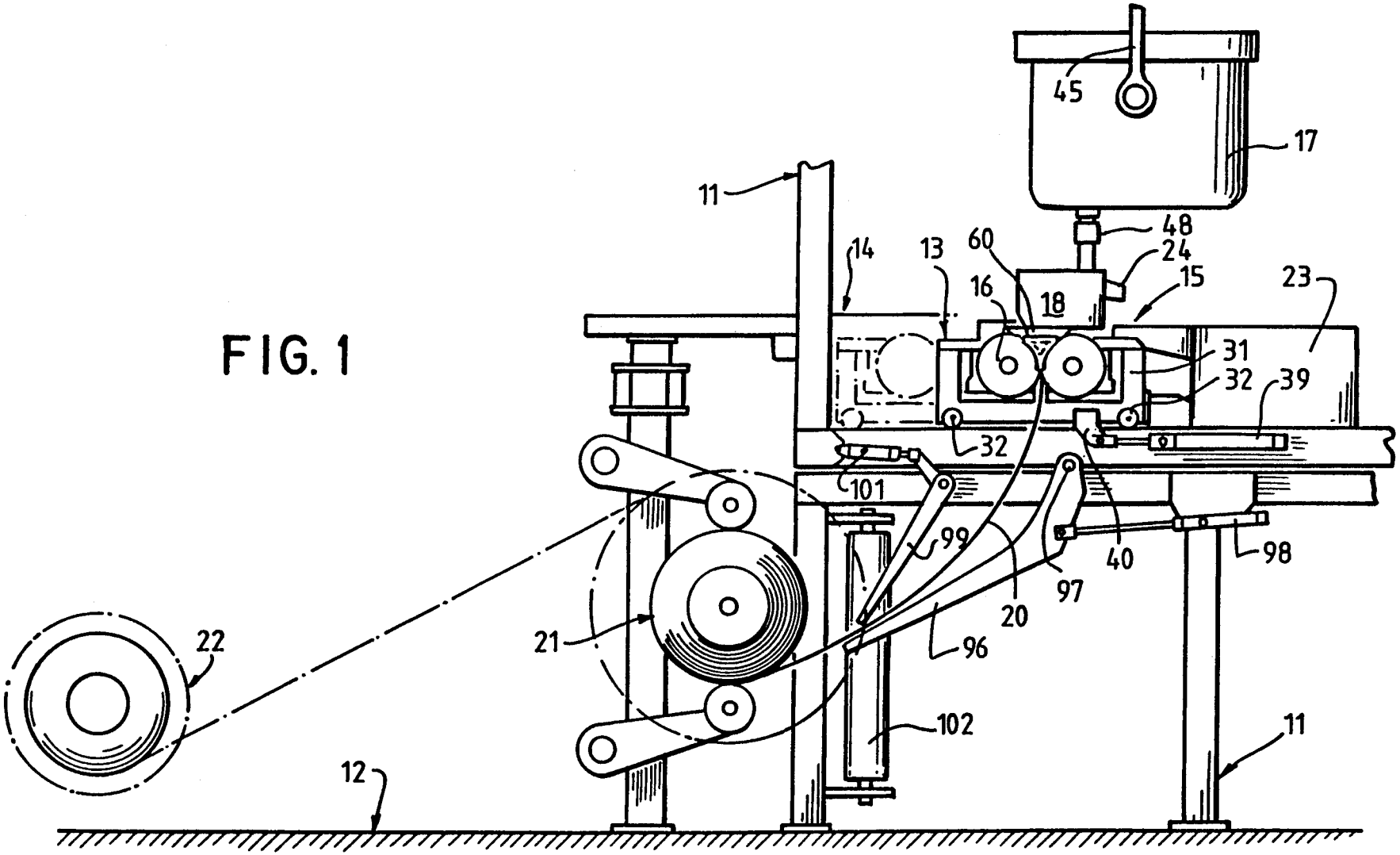
FIG. 1 illustrates a continuous strip caster incorporating apparatus constructed and operating in accordance with the present invention.
Figure 2:
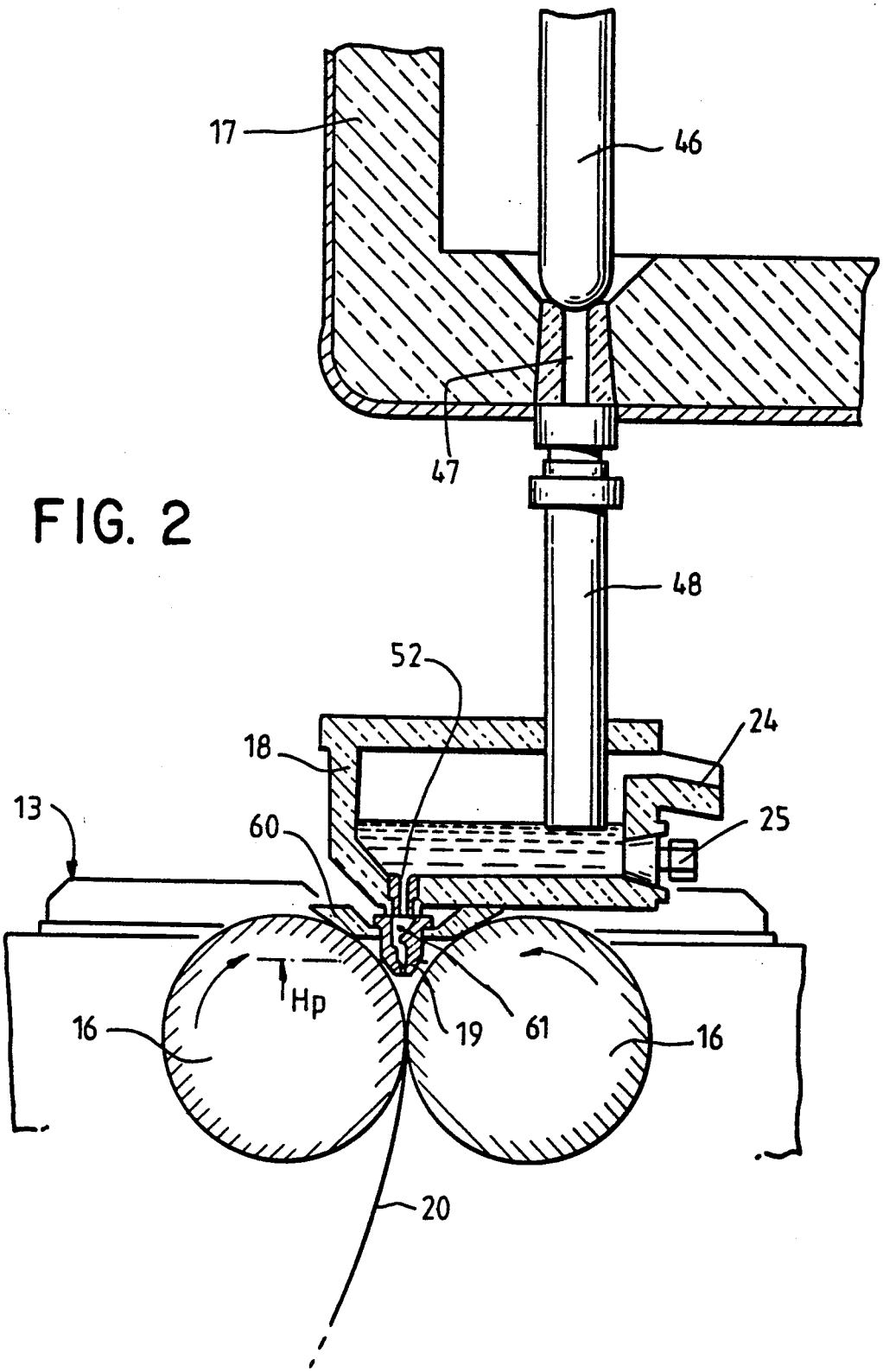
FIG. 2 is a vertical cross-section through important components of the caster illustrated in FIG. 1 including a metal delivery nozzle constructed in accordance with the invention.
Figure 3:
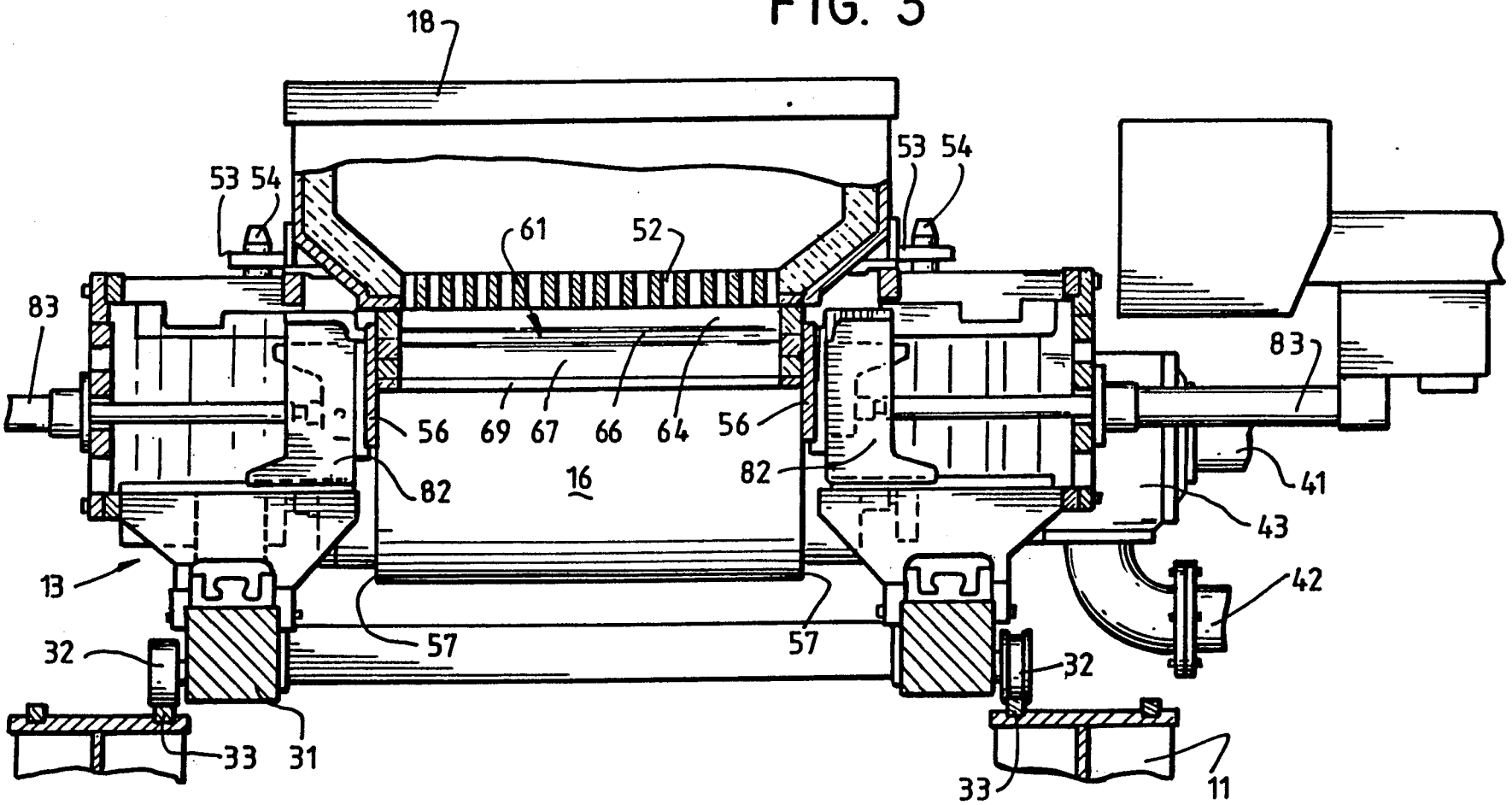
FIG. 3 is a further vertical cross-section through important components of the caster taken transverse to the section of FIG. 2.

The illustrated caster comprises a main machine frame 11 which stands up from the factory floor 12. Frame 11 supports a casting roller carriage 13 which is horizontally movable between an assembly station 14 and a casting station 15. Carriage 13 carries a pair of parallel casting rollers 16 to which molten metal is supplied during a casting operation from a ladle 17 via a tundish 18 and delivery nozzle 19. Casting rollers 16 are water cooled so that shells solidify on the moving roller surfaces and are brought together at the nip between them to produce a solidified strip product 20 at the roller outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roller carriage 13 comprises a carriage frame 31 mounted by wheels 32 on rails 33 extending along part of the main machine frame 11 whereby roller carriage 13 as a whole is mounted for movement along the rails 33. Carriage frame 31 carries a pair of roller cradles 34 in which the rollers 16 are rotatably mounted. Carriage 13 is movable along the rails 33 by actuation of a double acting hydraulic piston and cylinder unit 39, connected between a drive bracket 40 on the roller carriage and the main machine frame so as to be actuable to move the roller carriage between the assembly station 14 and casting station 15 and visa versa.

Casting rollers 16 are contra rotated through drive shafts 41 from an electric motor and transmission mounted on carriage frame 31. Rollers 16 have copper peripheral walls formed with a series of longitudinally extending and circumferentially spaced water cooling passages supplied with cooling water through the roller ends from water supply ducts in the roller drive shafts 41 which are connected to water supply hoses 42 through rotary glands 43. The rollers may typically be about 500 mm diameter and up to 1300 mm long in order to produce 1300 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as high alumina castable with a sacrificial lining. One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roller carriage frame 31 and provided with apertures to receive indexing pegs 54 on the carriage frame so as accurately to locate the tundish.

Delivery nozzle 19 is formed as an elongate body made of a refractory material such as alumina graphite. Its lower part is tapered so as to converge inwardly and downwardly so that it can project into the nip between casting rollers 16. A mounting bracket 60 is provided to support the nozzle on the roller carriage frame and the upper part of the nozzle is formed with outwardly projecting side flanges 55 which locate on the mounting bracket.

Delivery nozzle 19 has an upwardly opening inlet trough 61 to receive molten metal flowing downwardly through the openings 52 of the tundish and a metal flow passage 62 extending from the bottom of trough 61 downwardly to a metal flow outlet slot 69 which extends longitudinally of the nip between the casting rollers. In accordance with the present invention, inlet trough 61 is defined between a substantially vertical side wall surface 63 and an opposite side wall surface 64 which slopes downwardly and across the trough to the upper end of the metal flow passage 62. Accordingly, the bottom of trough 61 and the upper end of flow passage 62 are displaced laterally from the central plane of the outlet nozzle which contains the outlet slot 69.

Molten metal falls from the outlet openings 52 of the tundish in a series of free falling vertical streams 65 which are intercepted by the sloping side wall surface 64 of the inlet trough at an acute angle of impingement such that the molten metal tends to adhere to the sloping side wall and to spread into the form of a sheet 70 flowing down the side wall surface. It has been found that with correct positioning and sloping of the side wall surface it is possible to cause the downwardly flowing molten metal to quickly and smoothly adhere to that surface with little splash and turbulence. More particularly, it has been found that with impingement angles of between 10° and 50°, and preferably between 20° and 40° the cohesive forces between the molten metal and the refractory material of the nozzle produce a sufficient "wetting" action between the metal and the refractory material to cause the molten metal to quickly and smoothly adhere to the wall surface 64 to produce a smooth flowing sheet 70 along the length of the nozzle so that the kinetic energy of the falling metal is rapidly but smoothly reduced.

Wall surface 64 is curved downwardly and inwardly of the trough so as to direct the flowing sheet of metal to the upper end of outlet passage 62 with progressively increasingly slope away from the vertical direction so as to enhance this progressive reduction of kinetic energy in the flowing sheet. More particularly, the wall surface curves progressively from an angle of about 20° from vertical at the upper end of the wall to an angle of about 70° from vertical at the bottom of the trough 61. The molten metal streams 65 are intercepted by a mid-part of the wall surface at an impingement angle of about 30°.

Metal flow passage 62 has an upper curved portion 66 which bends back toward the central plane of the nozzle against the transverse deflection of metal flow in the trough. This upper portion 66 leads smoothly into a lower vertical portion 67 which extends down to the outlet slot 69. The curved upper part of flow passage 66 further reduces the kinetic energy of the flowing metal by deflecting that flow transversely of the nozzle back against the direction of deflection in the inlet trough. A further reduction of kinetic energy is achieved by a discrete constriction 68 in the vertical lower portion 67 of the flow passage 62.

The illustrated nozzle achieves a three stage reduction of kinetic energy. In the first stage, kinetic energy is reduced by the capture of the stream in a sheet on the wall surface 64 by wetting action or cohesive forces between the metal and the wall surface and the simultaneous lateral deflection of the flowing metal away from the vertical. In the second stage there is a further reduction due to the deflection of the stream transversely of the vertical direction against the transverse direction of the flow in the trough. The constriction 68 in passage 62 above the outlet slot provides a third stage reduction. It has been found that this progressive multi-stage reduction of energy can be such that it is not necessary to have a narrow slot to build up a molten pool in the nip between the casting rollers and it is possible to run the equipment with a wider outlet slot than hither to. Moreover, localised widening of the outlet slot on preheating of the refractory material can also be accommodated without causing defects due to uneven flow conditions as experienced with previous equipment.

Figure 4:
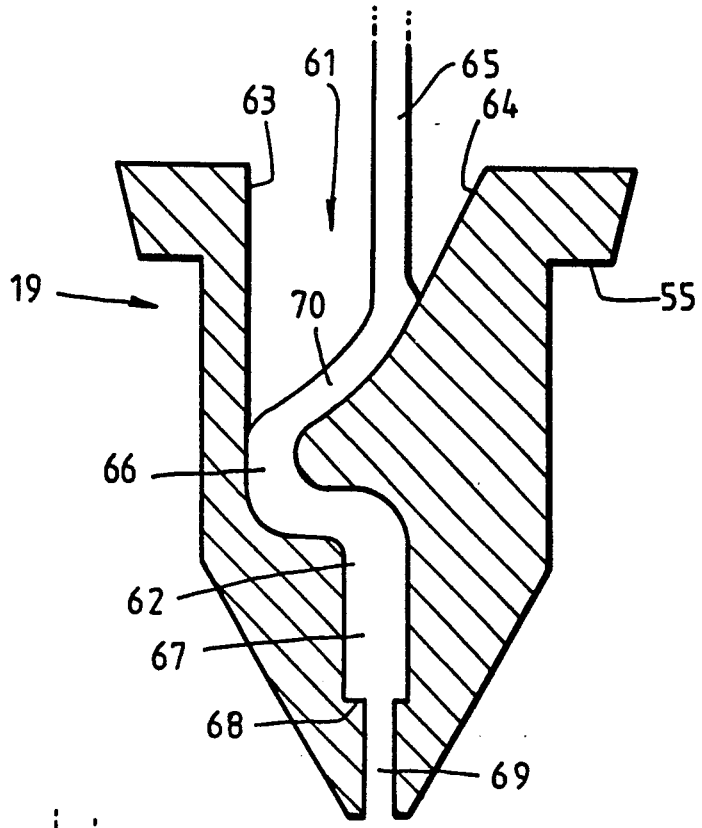
FIG. 4 is an enlarged transverse cross-section through the metal delivery nozzle.
Figure 5:
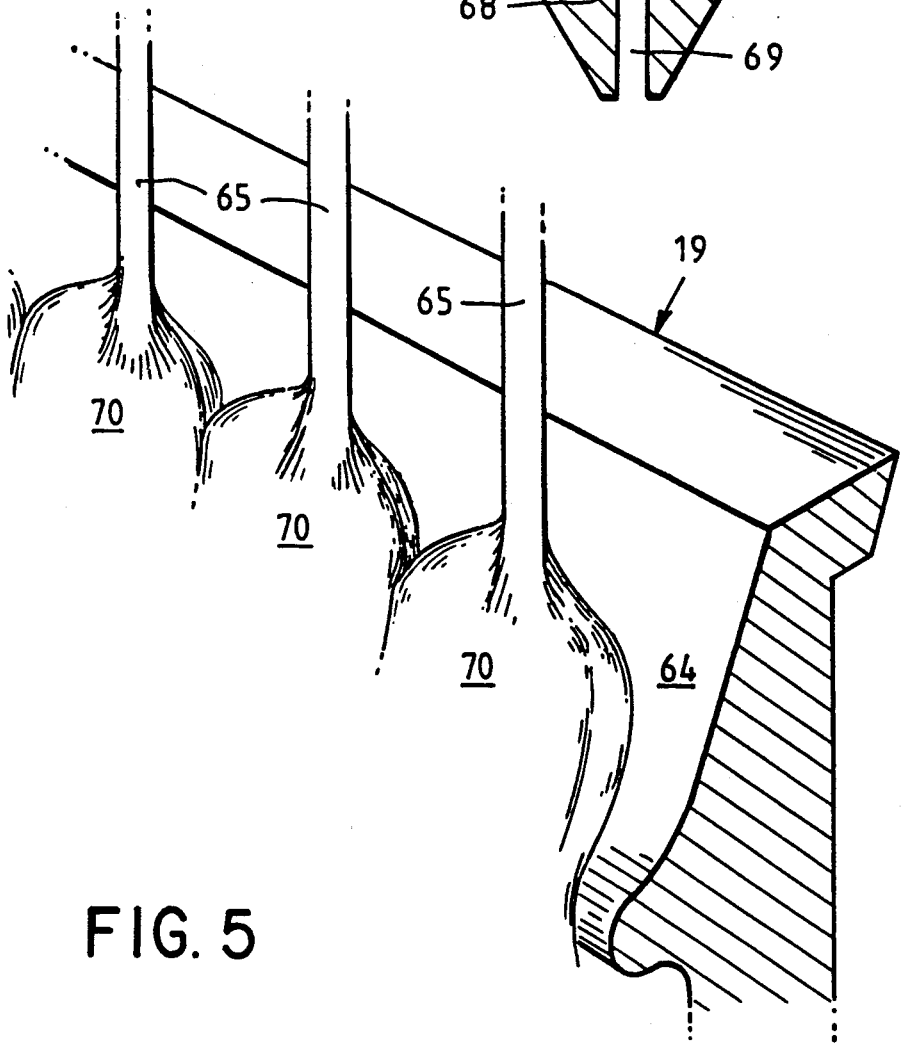
FIG. 5 is a broken away perspective view of part of the metal delivery nozzle illustrating how a series of falling metal streams impinge on a sloping wall surface of the nozzle and merge into a single sheet flow down that wall surface.
Figure 6:
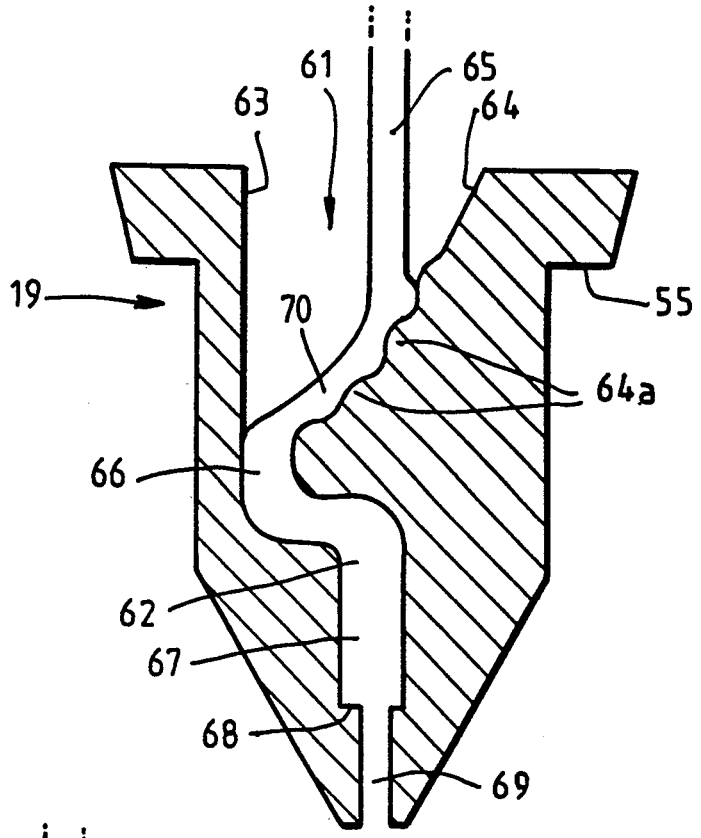
FIG. 6 is a transverse cross-section through a modified form of metal delivery also constructed in accordance with the invention.
Figure 7:
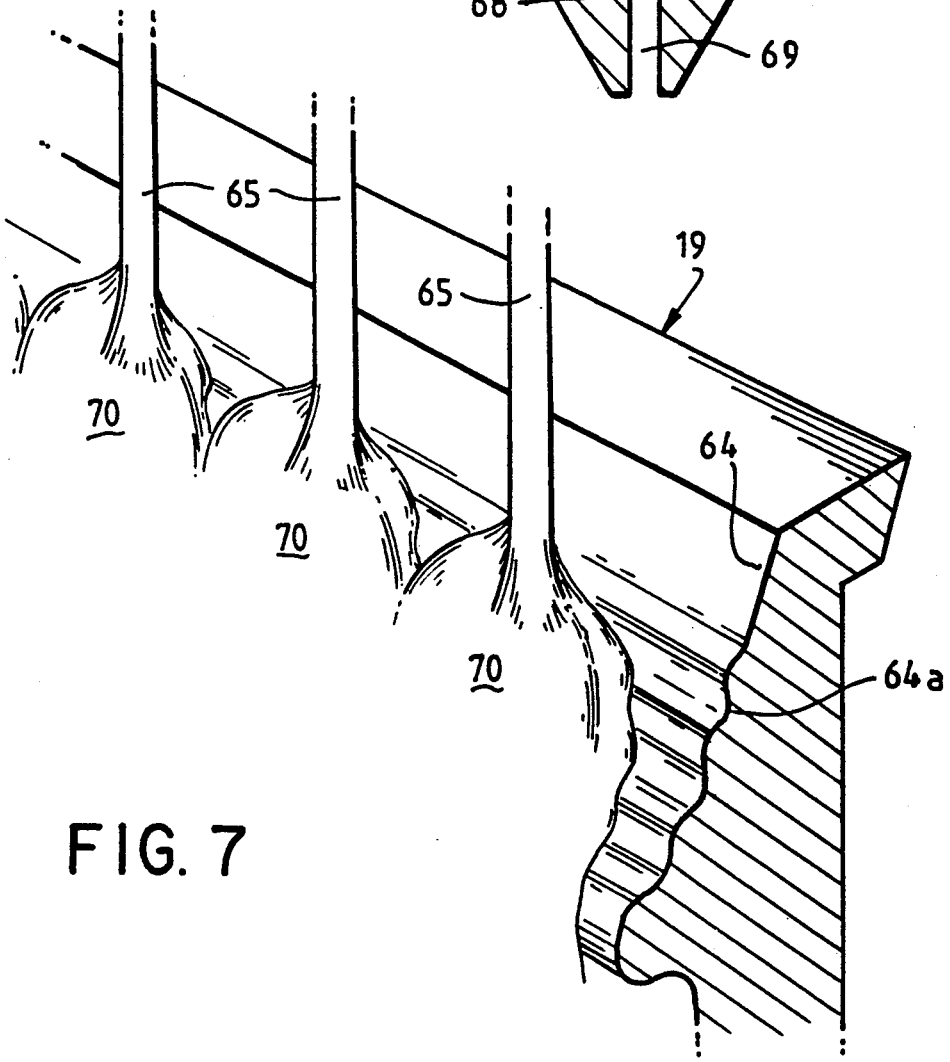
FIG. 7 is a broken away perspective view of part of the nozzle illustrated in FIG. 6 during operation to promote a single flowing sheet of molten metal.

FIGS. 6 and 7 illustrate a modification to the delivery nozzle in which the side wall surface 64 has a surface pattern in the form of a series of parallel corrugations or undulations 64*a* extending along the trough and transverse to the direction of the falling streams 65. The corrugations 64*a* promote spreading of the molten metal across the surface 64 transverse to the general direction of flow of the metal and so assist in the rapid establishment of the continuous flowing sheet 70 and reduction of the kinetic energy of the flowing metal. As in the previous embodiment the wall surface 64 curves downwardly and across the trough with increasing sope to the vertical and apart from the provision of the corrugations 64*a* the nozzle may be entirely the same as that illustrated in FIGS. 4 and 5.

In a typical ferrous caster constructed in accordance with the invention, the tundish openings may be circular openings of 8 mm diameter arranged at 50 mm spacing. The outlet flow passage 62 may typically be 10 mm wide at its upper end increasing to a width of 15 mm upstream of the constriction 68 and reducing to 1 to 7 mm at the outlet slot.

We claim:

1. In the method of casting metal strip comprising introducing molten metal between a pair of parallel casting rollers from a metal delivery nozzle disposed above the nip between the rollers wherein the delivery nozzle has an upwardly opening outlet trough adapted to receive molten metal, and a metal flow passage extending downwardly from the bottom of the inlet trough to a metal flow outlet from the nozzle and supplying molten metal to the delivery nozzle in at least one stream so as to impinge said molten metal on a side wall surface of the inlet trough of the nozzle;

the improvement which comprises said wall surface being curved inwardly and downwardly of said trough, and impinging said molten metal on said curved wall surface at an acute angle, with respect to the stream of molten metal, of impingement, such that said stream adheres to the side wall surface to form a flowing sheet of metal on the side wall surface which is directed, at an increasing slope away from the direction of introduction of said molten metal, by the side wall surface into the outlet flow passage.

2. A method as claimed in claim 1, wherein said angle of impingement is in the range of 10° to 50°.

3. A method as claimed in claim 1 wherein the outlet passage is shaped to direct metal flowing therethrough transversely of the nozzle against the direction of transverse deflection of the flow in the trough.

4. A method as claimed in claim 3, wherein the outlet passage has an upper portion which extends transversely of the nozzle against the transverse deflection of the flow in the trough and a lower portion which extends substantially vertically to the nozzle outlet.

5. A method as claimed in claim 4, wherein said lower part of the outlet passage has a discrete constriction spaced above the nozzle outlet.

6. A method as claimed in claim 1 including providing said side wall surface with a pattern, which comprises a plurality of corrugations extending transversely to the direction of said introduction of said molten metal, which promotes spreading of the molten metal transversely of the direction of said stream.

7. A metal delivery nozzle for delivering molten metal to a nip between a pair of casting rollers, comprising an upwardly opening inlet trough adapted to receive at least one free falling stream of molten metal and a metal flow passage extending downwardly from the bottom of the inlet trough to a metal flow outlet of the nozzle, wherein the trough has a side wall surface which curves downwardly and inwardly across the trough to the metal flow passage whereby, in use of the nozzle, said free flowing stream of molten metal impinges on said side wall surface at an acute angle, with respect to said falling stream of metal, of impingement such that said molten metal impinging on the side wall surface will adhere to that wall surface and flow in a sheet, with a progressively increasing slope away from the vertical, directed to the outlet passage.

8. A metal delivery nozzle as claimed in claim 7, wherein the outlet passage is shaped to direct metal flowing therethrough transversely of the nozzle against the direction of transverse deflection of flow in the trough due to the slope of said side wall surface across the trough.

9. A metal delivery nozzle as claimed in claim 8, wherein the outlet passage has an upper portion which extends transversely of the nozzle against the direction of transverse deflection of the flow in the trough due to the downward slope of said side wall surface across the trough and a lower portion which extends substantially vertically to the nozzle outlet.

10. A metal delivery nozzle as claimed in claim 7, wherein said side wall surface has a pattern, comprising a plurality of substantially parallel corrugations formed in said surface and extending along said trough, which in use of the nozzle promotes spreading of the impinging molten metal transversely to the direction of metal flow.

11. A method of casting metal strip of the kind in which molten metal is introduced between a pair of parallel casting rollers via a metal delivery nozzle disposed above the nip between the rollers, wherein the delivery nozzle has an upwardly opening elongate inlet trough extending longitudinally of the nip to receive molten metal and a metal flow passage extending downwardly from the bottom of the inlet trough to a metal flow outlet from the nozzle, the nozzle inlet trough has a side wall surface which slopes downwardly and across the trough, and the molten metal is delivered to the nozzle in a series of discrete free falling vertical streams spaced apart longitudinally of the trough and each impinging on said side wall surface of the nozzle at an acute angle of impingement in the range 10° to 50 ° whereby molten metal from the streams adheres to the side wall surface and spreads into the form of a single sheet of molten metal which flows down the side wall surface into the outlet flow passage.

12. A method as claimed in claim 11, wherein the outlet passage is shaped to direct metal flowing therethrough transversely of the nozzle against the direction of transverse deflection of the flow in the trough due to impingement with said side wall surface.

13. A method as claimed in claim 11, wherein the outlet passage has an upper portion which extends transversely of the nozzle against the transverse deflection of the flow in the trough and a lower portion which extends substantially vertically to the nozzle outlet.

14. A method as claimed in claim 13, wherein said lower part of the outlet passage has a discrete constriction spaced above the nozzle outlet.

15. Apparatus for casting metal strip, comprising a pair of parallel casting rollers forming a nip between them, a metal delivery nozzle disposed above the nip between the casting rollers for delivery of molten metal into the nip and a tundish disposed above the delivery nozzle for supply of molten metal to the delivery nozzle, wherein the metal delivery nozzle comprises an upwardly opening elongate inlet trough extending longitudinally of the nip to receive molten metal from the tundish and a metal flow passage extending downwardly from the bottom inlet trough to a metal flow outlet from the nozzle, the nozzle inlet trough has a side wall surface which slopes downwardly and across the trough, the tundish has a series of flow outlets disposed in a linear array extending longitudinally of the delivery nozzle trough and directly above said side wall surface of the trough such that in use of the apparatus molten metal will fall freely under gravity from the tundish nozzle outlets in a series of discrete vertical streams to impinge on said side wall surface of the nozzle at an acute angle of impingement in the range 10° to 50 °.

16. Apparatus as claimed in claim 15, wherein the outlet passage of the delivery nozzle has an upper portion which extends transversely of the nozzle against the direction toward which said side wall surface slopes within the trough and a lower portion which extends substantially vertically to the nozzle outlet.

17. Apparatus as claimed in claim 16, wherein said lower part of the outlet passage has a discrete constriction spaced above the nozzle outlet.

18. Apparatus as claimed in claim 15, wherein said side wall surface is provided with a plurality of parallel corrugations extending along the trough.

* * * * *